US007334748B2

(12) United States Patent
Maynard

(10) Patent No.: US 7,334,748 B2
(45) Date of Patent: Feb. 26, 2008

(54) METHOD AND APPARATUS FOR GRANULATING PLASTIC

(75) Inventor: Donald E. Maynard, St. John's, MI (US)

(73) Assignee: Size Reduction Specialists Corporation

( * ) Notice: Subject to any disclaimer, the term of this patent is extended or adjusted under 35 U.S.C. 154(b) by 0 days.

(21) Appl. No.: 11/287,928

(22) Filed: Nov. 28, 2005

(65) Prior Publication Data

US 2006/0102761 A1 May 18, 2006

Related U.S. Application Data

(62) Division of application No. 10/211,874, filed on Aug. 2, 2002, now Pat. No. 6,978,956, which is a division of application No. 09/602,909, filed on Jun. 23, 2000, now Pat. No. 6,450,427.

(60) Provisional application No. 60/140,875, filed on Jun. 24, 1999.

(51) Int. Cl.
*B02C 18/16* (2006.01)

(52) U.S. Cl. ..... 241/243; 241/295

(58) Field of Classification Search ..... 241/242, 241/243, 294, 295, 293; 83/500–503
See application file for complete search history.

(56) References Cited

U.S. PATENT DOCUMENTS

| | | | | |
|---|---|---|---|---|
| 1,826,891 A | | 10/1931 | Krogan | |
| 2,609,150 A | | 9/1952 | Bludeau | |
| 3,037,540 A | * | 6/1962 | Bloomquist et al. | 241/282.1 |
| 4,083,668 A | | 4/1978 | Bardwick, III et al. | |
| 4,099,678 A | * | 7/1978 | Brewer | 241/243 |
| 4,151,960 A | | 5/1979 | Peterson, Jr. | |
| 4,377,261 A | | 3/1983 | Dumaine et al. | |
| 4,454,995 A | * | 6/1984 | Bloomquist | 241/277 |
| 4,545,538 A | * | 10/1985 | Prew | 241/73 |
| 4,580,733 A | | 4/1986 | Nakagomi | |
| 4,706,899 A | * | 11/1987 | Parker et al. | 241/73 |
| 4,750,678 A | | 6/1988 | Lodovico et al. | |
| 4,840,315 A | | 6/1989 | Rubin et al. | |
| 5,011,087 A | | 4/1991 | Richardson et al. | |

(Continued)

FOREIGN PATENT DOCUMENTS

DE 90 00 349.7 5/1990

(Continued)

OTHER PUBLICATIONS

"Ball & Jewell Introduces New Explorer Screenless Granulator" from www.sterlco.com website (Jul. 5, 2000).

(Continued)

*Primary Examiner*—Mark Rosenbaum
(74) *Attorney, Agent, or Firm*—Gifford, Krass, Sprinkle, Anderson & Citkowski, P.C

(57) ABSTRACT

A granulator has a first coarse cutting stage operating at between 5 and 45 rotations per minute and a second fine cutting stage operating at two to ten times the speed of the first stage. Since granulate exiting the second stage is uniformly divided, the granulator operates independent of a screen. A first cutter stage has cutting segments having blades interspersed with deflector segments about a shaft. Rotation of the shaft urges the blades past a spaced stationary cutter.

11 Claims, 6 Drawing Sheets

U.S. PATENT DOCUMENTS

| | | | | |
|---|---|---|---|---|
| 5,054,694 | A | 10/1991 | Knobloch et al. | |
| 5,110,060 | A | 5/1992 | Lundquist | |
| 5,143,307 | A | 9/1992 | Lundquist | |
| 5,195,685 | A * | 3/1993 | Dumaine | 241/242 |
| 5,402,948 | A | 4/1995 | Kaczmarek | |
| RE35,202 | E | 4/1996 | Baltensperger et al. | |
| 5,566,894 | A | 10/1996 | Karch | |
| 5,616,550 | A | 4/1997 | Kruse et al. | |
| 6,053,442 | A * | 4/2000 | Matsuo | 241/154 |
| 6,260,780 | B1 * | 7/2001 | Kroger et al. | 241/236 |

FOREIGN PATENT DOCUMENTS

| | | | |
|---|---|---|---|
| DE | 39 08 395 | A1 | 9/1990 |
| DE | 44 27 903 | A1 | 2/1996 |
| FR | 2 691 079 | A1 | 11/1993 |
| JP | 09057142 | | 3/1997 |

OTHER PUBLICATIONS

"Putting It All Together—Explore A New Dimension In Sprue & Runner Granulating", Sterling, Inc. (2000).
"S3 Tri-Axle Shear Cutter . . . An Advanced Granulator For Soft & Hard Materials", Nissui Corp., undated.
"The Highest Quality Through The Latest Technology", Nissui Corp. (Jul. 1999).
"Sound Reduced—Plastics Granulators", Castin Industrial Trading Ltd., undated.
"Gran Cutter Swing Press Cutter System for Sprues and Runners", Harmo Soken Co., Ltd., undated.
Nissui Corp. brochure, undated.
"Cutter The Latest No Screen Technology In Beside-The-Press Granulators", Nissui Corp., undated.

* cited by examiner 12
50
28
30
39
18
32
13
58
38
56
42
36
46
16
52
54
20
44
48

METHOD AND APPARATUS FOR GRANULATING PLASTIC

RELATED APPLICATIONS

This application is a divisional of U.S. patent application Ser. No. 10/211,874 filed Aug. 2, 2002 now U.S. Pat. No. 6,978,956, which is a divisional of U.S. patent application Ser. No. 09/602,909 filed Jun. 23, 2000 now U.S. Pat. No. 6,450,427, which claims priority of U.S. Provisional Patent Application 60/140,875 filed Jun. 24, 1999, which are incorporated herein by reference.

FIELD OF THE INVENTION

The present invention relates to a method and apparatus for granulating material and more particularly for granulating plastic and metal articles.

BACKGROUND OF THE INVENTION

Plastic granulators are used to fragmentize piece scrap or waste plastic material resulting from the production of various articles such that granulated pieces can be recycled into article production operations. Similarly, waste from molding processes are granulated prior to shipment and reprocessing. Efficient granulation requires that large quantities of scrap material be gravity fed into an apparatus and uniform compact granulate exit the apparatus.

One type of granulator uses a two-stage cutting process to successively coarse cut and granulate plastic. Often, a two-stage granulator requires the use of a screen prior to material discharge from the apparatus to assure granulate uniformity. U.S. Pat. Nos. 4,151,960; 4,377,261 and 5,402,948 are representative of two-stage granulators using a screen. Access to the screen is generally obtained by physically removing portions of the granulating apparatus resulting in operational downtime. Screen cleaning is periodically necessary to remove debris clogging the screen mesh.

Existing two-stage granulators often utilize more than two rotating shafts in order to operate a two-stage cutting process. U.S. Pat. Nos. 1,826,891; 4,750,678 and 5,143,307 are representative of two-stage granulators using more than two shafts. The synchronization in torque driving of interworking shafts requires comparatively complex gearing to adequately control the results in inefficient operation and both stages are not being taxed equally.

Existing two-stage granulators typically operate at speeds of between 50 and about 1000 rpms. Such high speed operation consumes considerable power, and presents unnecessary safety and maintenance demands on granulator operation. Thus, there exists a need for a two-stage granulator operating with two shafts at low speed and independent of screens.

Another type of granulator uses a single shaft having interspersed coarse cutters and fine cutters operating at about 30 rpm. U.S. Pat. No. 4,580,733 is representative of this design. The efficiency of such a single stage design is limited by the considerable torque needed to turn the unbalanced shaft and the limited throughput associated with fine cutters having to grind coarse material. Thus, there exists a need for a granulator cutter assembly that promotes uniform cutting torque and high throughput.

SUMMARY OF THE INVENTION

A granulator apparatus includes a first stage cutter mounted on a first shaft. A second stage cutter is mounted on a second shaft generally parallel to the first shaft and located to receive material after encountering the first stage cutter. A motor is coupled to the first and second shafts in order to rotate the first stage cutter at a rate between 5 and 50 rotations per minute and the second stage cutter at between two and ten times the rate of the first cutter. An exit aperture receives material having encountered the second stage cutter wherein a path is defined through said first and said second stage cutters and the exit aperture, the path being independent of a screen.

A screenless granulator apparatus is also disclosed which includes a first rotating cutting segment having a plurality of blades, the blades rotating against a stationary cutter. The first rotating cutting segment being mounted on a shaft. An angled gravity fed load bin is mounted above said first rotating cutting segment, the bin having a side wall terminating proximal to said stationary cutter and angled to promote travel of material through said bin along the side wall in preference to other wall components of the bin.

A method of granulating material includes the steps of shearing the material between a rotating blade of a first stage coarse cutter and a stationary first cutter to form coarsely divided granulate, wherein the blade rotates about a first shaft at a rate of between 10 and 20 rotations per minute. Thereafter, the coarsely divided granulate is sheared between a second blade of a rotating second stage cutter and a stationary second stage cutter to form finely divided granulate wherein the second stage rotating cutter rotates at a second rate greater than the first stage rotating cutter and the second rate is less than 60 rotations per minute. Finely divided granulate is then removed from the second stage cutter without said finely divided granulate contacting a screen.

DESCRIPTION OF THE PREFERRED EMBODIMENTS

Figure 1A:
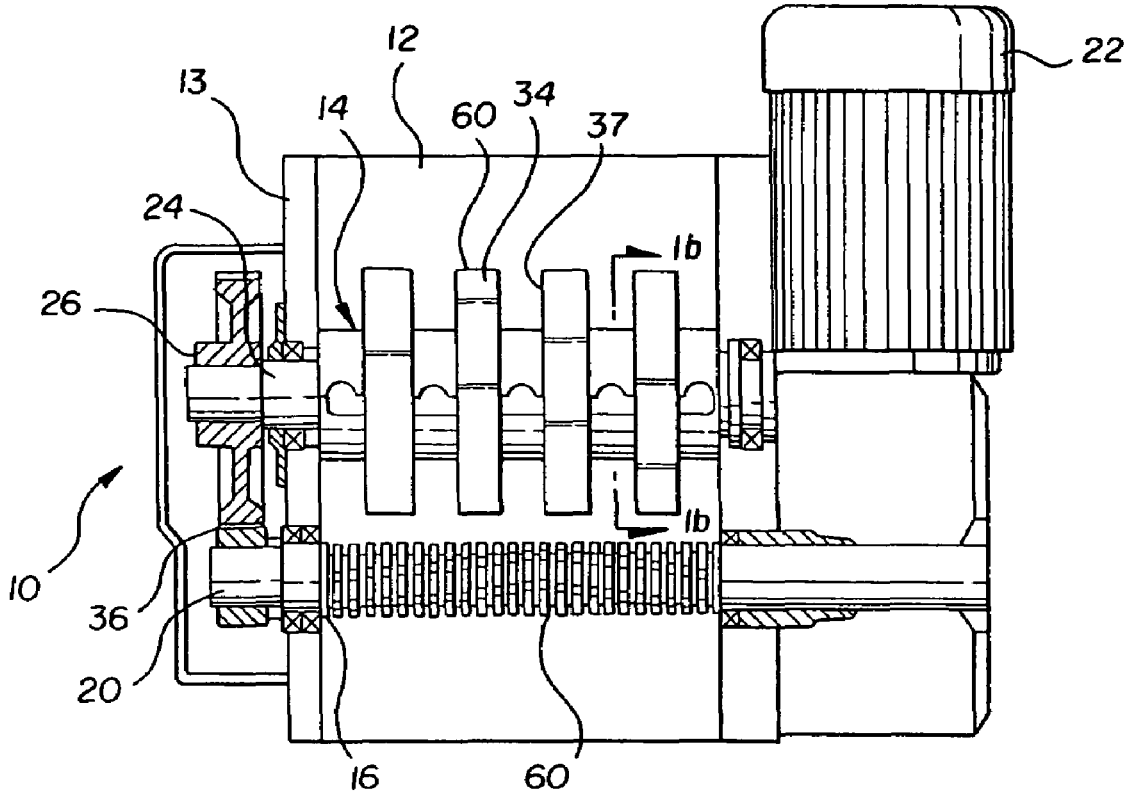
FIG. 1(*a*) is a fragmentary side view of a preferred embodiment of the present invention and 1(*b*) is a cross-sectional view along the line A-A.
Figure 1B:
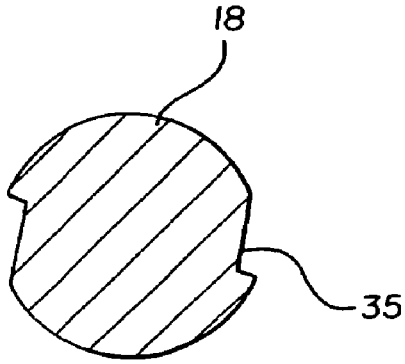
Figures 2A, 2B:
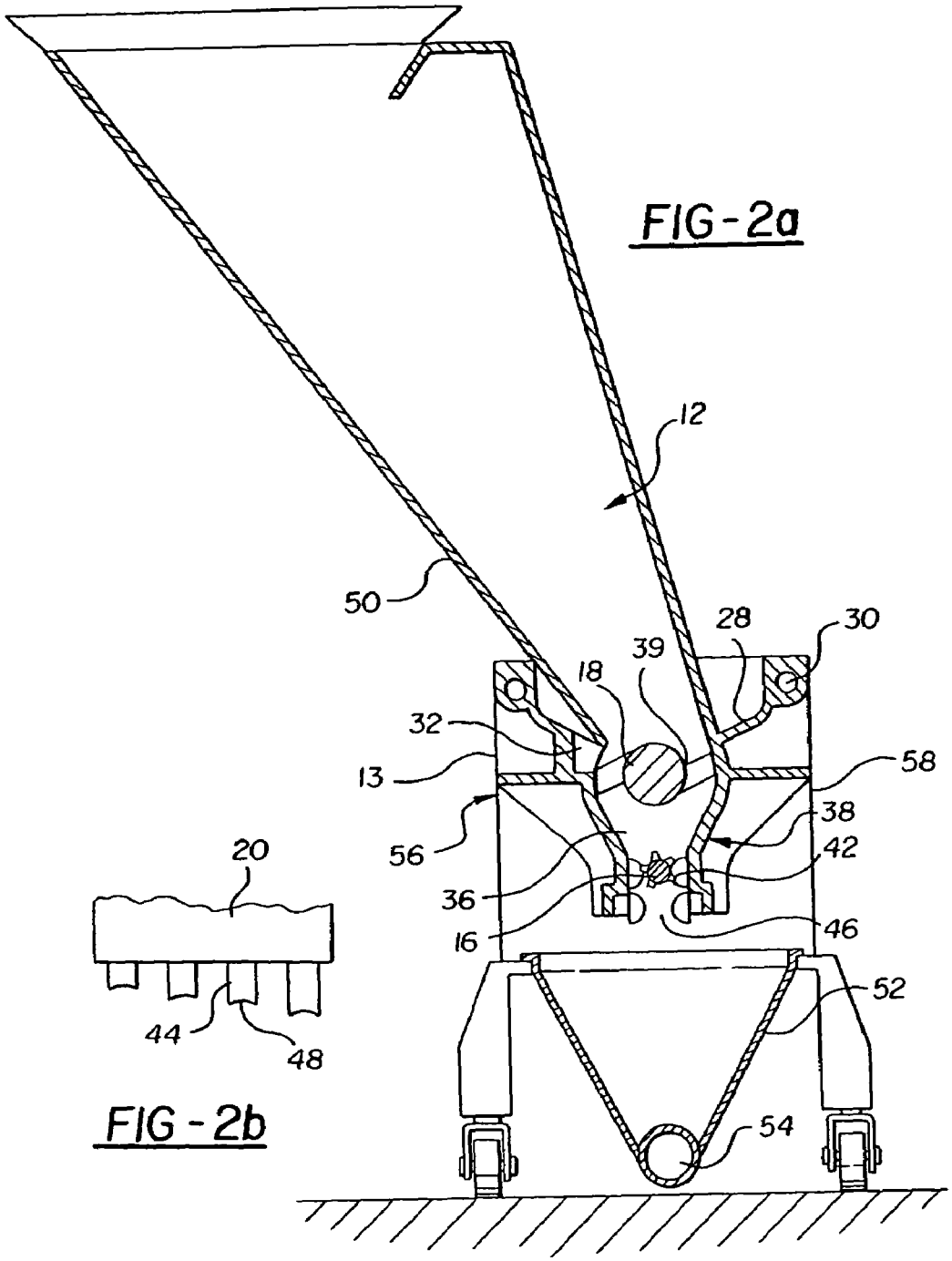
FIG. 2(*a*) is a side view of the two-stage cutting section of the embodiment depicted in FIGS. 1(*a*), and 2(*b*) is a cross-sectional view along line B-B.

As seen in FIGS. 1 and 2, the preferred embodiment of a granulator apparatus 10 for granulating waste plastic and sheet metal, includes a gravity fed loading bin 12, a first coarse cutting stage 14 and a second fine cutting stage 16.

The granulator apparatus of the present invention as depicted in FIGS. 1 and 2 are shown without cover panels, shields, stands or portions of the housing 13 in order to illustrate various operating components in features. The first cutting stage 14 is mounted about a first drive shaft 18. Likewise, the second fine cutting stage 16 is mounted about a second parallel drive shaft 20. Preferably, the first shaft 18 has a notch 35 in regions not enveloped by cutting segments 60 having rotating blades 34 to form material deflector segments 37, as shown in FIG. 1(*b*). Typical construction materials for a cutting stage according to the present invention include steel. Additionally, cutting surfaces are amenable to hardening procedures and coatings conventional to the art.

The material deflector segment 37 is characterized by having a cylindrical outer circumference save for a notch 35. The notch 35 serves to catch partly cut material resting against the shaft 18 and deflect such material into the path of a cutting blade 34. Furthermore, the notch 35 has been observed to nibble a fragment from plastic material, thereby providing some additional cutting capability. The outer circumference of a deflector segment 37 is optionally machined to include a plurality of the notch 35 to limit material accumulation between blade 34. Preferably, one to six notches are formed in a deflector segment 37. More preferably, two to six notches are present. Still more preferably, the notches are radially spaced about the shaft 18 to promote rotary balance. Thus, for example, two notches are formed in a diametric relationship on a deflector segment 37 as per FIG. 1(*b*). It is appreciated that a deflector segment is also formed as a slip collar adapted to fit about a shaft, thereby facilitating deflector segment replacement.

The first drive shaft 18 and second drive shaft 20 are powered by a motor 22 by way of a transfer shaft 24 engaging gearing 26 such that the first stage 14 rotates at a lesser speed than the second stage. A motor having between ½ and 10 horsepower is sufficient for most usages, although it is appreciated that the present invention is amenable to scaling to a variety of sizes both smaller and larger. Gear reduction ratios from the motor 22 to the drive shaft are typically between 10:1 and 100:1. Preferably the ratio is between 20:1 and 60:1. It is appreciated that pulley, belt drives and other power transfer components are readily coupled in the motor 22 to drive shafts 18 and 20 as well as other apparatus components. Preferably, the first stage 14 rotates at between 5 and 50 rpms and the second stage 16 rotates at between two and ten times the speed of the first stage 14. More preferably, the first stage rotates at between 10 and 20 rpms and the second stage 16 rotates at between two and four times the speed of the first stage 16. Still more preferably, the second stage 16 rotates at less than 60 rpms. Further, it is preferred that the second stage 16 rotates counter to the first stage 14.

Gravity fed loading bin 12 terminates within housing interior walls 28 which taper towards a coarse stationary cutter 32 and the rotating shaft 18 of the first cutting stage 14. The first cutting stage 14 includes a plurality of rotating cutting segments 60, each having blades 34 dispersed about the circumference of the first shaft 18. The gravity fed loading bin 12 preferably has a side wall 50 terminating proximal to the stationary cutter 32 such that sprues and other material slide down the side wall 50 directly into the path of the blades 34 without encountering a ledge or region likely to be bridged by material within the bin 12. The present invention overcomes the limitations associated with conventional right cylinder, cone or rectilinear bins which can readily be bridged by material lodging lengthwise across the bin opening. The side wall 50 promotes the linear feed of material into the blades 34 thereby lessening the likelihood of an obstruction in material feed. A minimal clearance exists between the first stage stationary cutter 32 and a rotating blade 34 such that feed stock contacting the first stage 14 is rotated towards the first stationary cutter 32 resulting in shearing of the feed stock material between the first stage stationary cutter 32 and a blade 34. Feed stock material that is pushed by a rotating blade 34 past stationary cutter 32 falls into a coarse granulate bin 36. Preferably, the first stage 14 has a plurality of cutting segments 60, each segment 60 having two blades 34. More preferably, the two rotating blades are diametrically opposed with a concave trailing edge 39, relative to the direction of rotation.

The coarse granulate bin 36 has walls 38 which taper towards an opening having a width suitable to allow insertion of a second stage stationary cutter 42 and the free rotation of the second cutting stage 16. The second cutting stage 16 includes a plurality of cutter segments 60', each having a plurality of rotating blades 44. A clearance exists between the stationary cutter 42 and a rotating blade 44 such that feed stock contacting the second stage 16 is rotated towards the second stationary cutter 42 resulting in shearing of the feed stock material between the second stage stationary cutter 42 in a rotating blade 44. Feed stock material that is pushed by a rotating blade 44 past stationary cutter 42 falls through a fine granulate exit aperture 46. The fine granulate passing the exit aperture 46 and falling into a collection bin 52. Optionally, a collector outlet tube 54 mounted at the base of the collection bin 52 facilitates automatic removal of granulate. The collector outlet tube 54 operating on a principle illustratively including suction, pressurized gaseous or liquid flow, or mechanical conveyance such as a screw or conveyor belt. Preferably, the second cutter stage 16 has more than three blades 44 per secondary cutting segment 60'. More preferably, the rotating blades 44 are angularly spaced at regular intervals about the secondary cutting segment 60' and with a concave cutting edge 48, as shown in FIG. 2(*b*). Still more preferably, the concave cutting edge 48 is rotationally staggered relative to blades on proximal secondary cutting segments 60', FIG. 2(*b*).

Preferably, the interior housing walls 28 and coarse granulate bin walls 38 are integrated to form two opposing side sections 56 and 58 along the length of the coarse 14 and fine 16 rotating cutting stages. One integrated side section 56 containing the first stage stationary cutter 32, while the other side section 58 contains the second stage stationary cutter 42. More preferably, a side section according to the present invention is mounted on a hinge pin 30 to facilitate access to the rotating cutting stages 14 and 16.

Figure 3A:
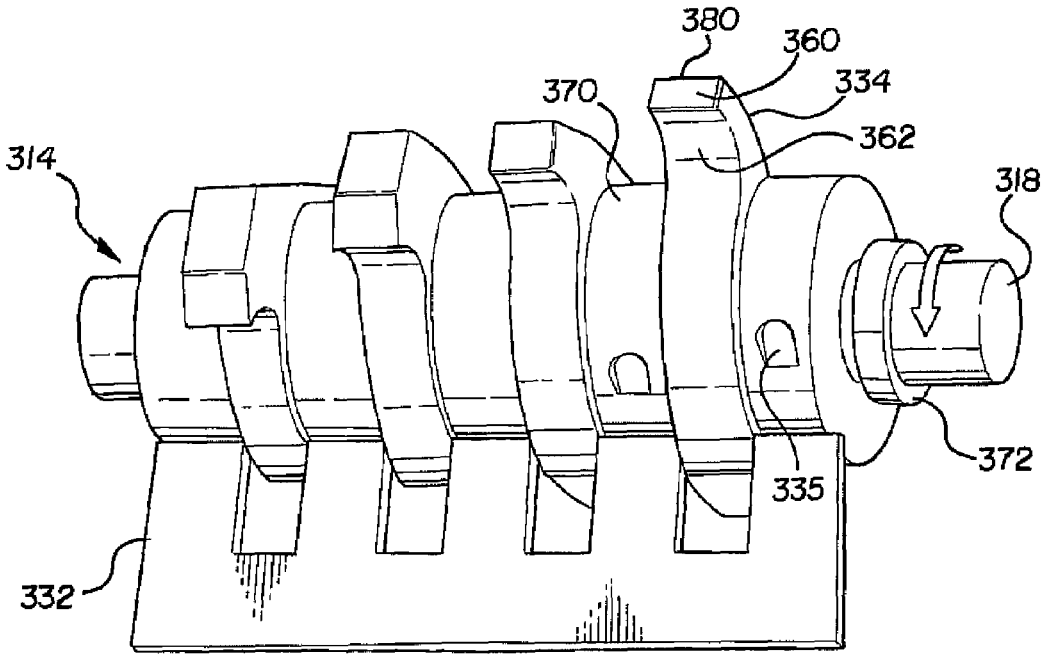
FIG. 3(*a*) is a perspective view of a first stage cutter assembly according to the present invention and 3(*b*) is an exploded top view of the FIG. 3(*a*) first stage cutter assembly.
Figure 3B:
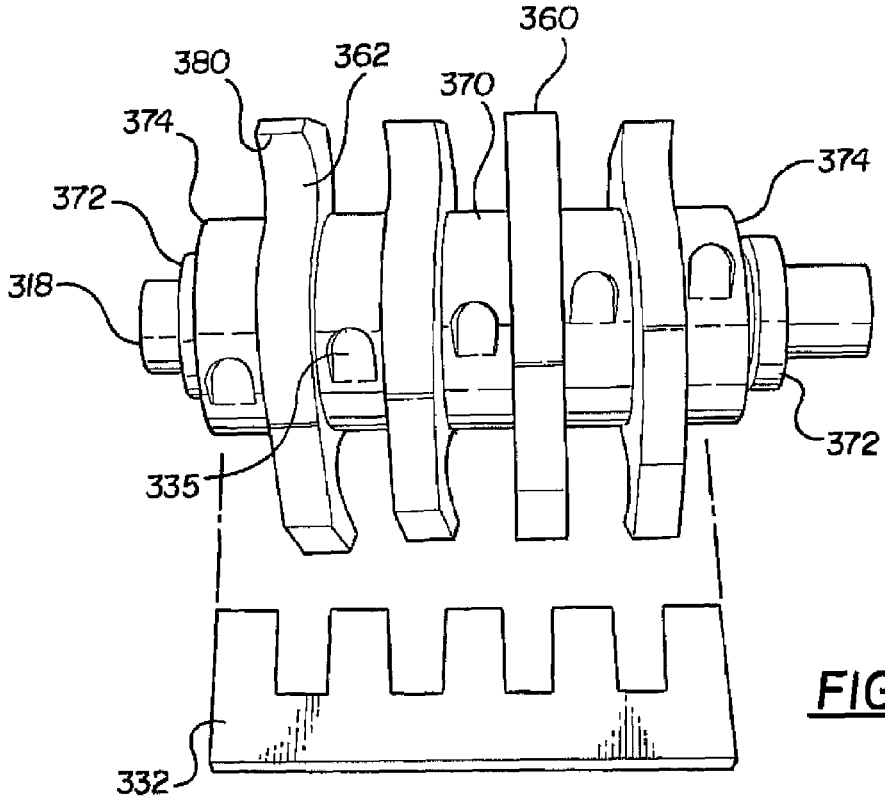

FIG. 3(*a*) is a perspective view of a first stage cutter assembly according to the present invention and FIG. 3(*b*) is an exploded top view of the FIG. 3(*a*) first stage cutter assembly. A coarse stationary cutter 332 is positioned relative to a first cutting stage 314. The first cutting stage 314 capable of free rotation around a shaft (318). The first cutting stage 314 includes at least one cutter segment 360 adjacent to at least one deflector segment 370 mounted about a shaft 318. The shaft 318 has a bearing race 372 to allow free rotation of the shaft 318. Additionally, a low friction washer 374 is provided to prevent wear through contact with a stationary mounting housing (not shown) and further to prevent material from becoming lodged in a clearance gap. A cutter segment 360 includes a plurality of rotating blades 334 dispersed about the circumference of the cutter segment 360. The cutting edge 380 is particularly well suited for shearing soft or brittle polymers illustratively including polyvinyl chloride, acrylonitrile-butadiene-styrene copolymers (ABS), nylon, and polyethylene. It is appreciated that the cutter segment 360 and/or the deflector segment 570 is optionally integral to the rotating shaft 318. A clearance between the stationary cutter 332 and a blade 334 is between 0.5/1000 and ½ inch. Preferably, for the granulation of thermoplastic materials, the clearance is between 2/1000 and 4/1000 of an inch. The clearance between the deflector segments 370 and the stationary cutter 332 is between 1/1000 and ½ inch. Preferably, the clearance between a deflector segment 370 and a stationary cutter 332 for the granulation of thermoplastics is between 3/1000 and 5/1000 of an inch.

FIG. 3(*a*) and FIG. 3(*b*) show an embodiment of the present invention which includes a plurality of cutter segments 360, the blades 334 of each cutter segment 360 are staggered relative to the other cutter segments to lessen differences in rotational torque of the first cutting stage 314. Thus, in the embodiment depicted in FIGS. 3(*a*) and 3(*b*), the four cutter segments 360 sequentially pass the stationary cutter 332 such that only one blade at any given time during first cutter stage rotation is actively cutting material. Preferably, cutting segments and stationary cutters according to the present invention are constructed from a material having a Rockwell hardness of between 56 and 58. More preferably, the cutter segments 360 and stationary cutter are both constructed of D2 or CPM steel.

As shown in FIGS. 3(*a*) and 3(*b*), the cutting segments 360 each have two blades 334 diametrically opposed. Preferably, the trailing edge 362 of a blade 334 is concave in the operational cutting rotational direction. The deflector segments 370 have a cylindrical outer circumference and a notch 335. Preferably, there are approximately an equal number of notches 335 as there are blades 334 on the adjacent segment and a notch 335 is concave in the direction of rotation. More preferably, a notch 335 in a deflector segment 370 is rotationally staggered relative to an adjacent blade 334. Most preferably, a notch 335 leads an adjacent cutting blade by an angle of between 0.3 and 0.6 times the angular displacement between blades on an adjacent cutting segment. For example, in the embodiment depicted in FIG. 3 where two blades are spaced apart by 180° on a cutting segment 360, then the most preferred location for a notch 335 is between 54° and 108° in front of a blade. It is appreciated that while the embodiments of the present invention depicted herein that contain a plurality of cutter segments are shown as having an equal number of blades on all cutting segments, optionally cutting segments of a first stage cutter having varying numbers of blades. Thus, cutter segments having two blades are readily used in conjunction with cutter segments having more than two blades.

Figure 4:
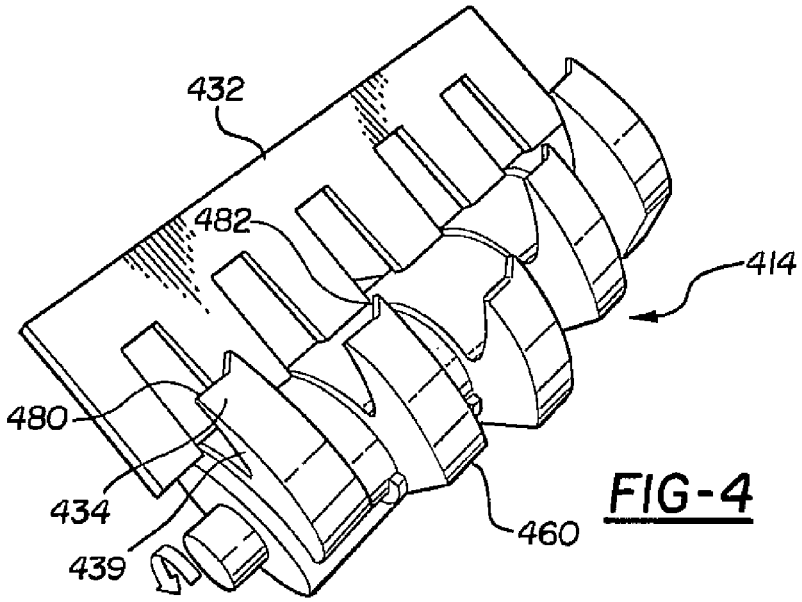
FIG. 4 is a perspective view of another embodiment according to the present invention of a first stage cutter assembly depicting a tipped cutting blade.
Figure 5C:
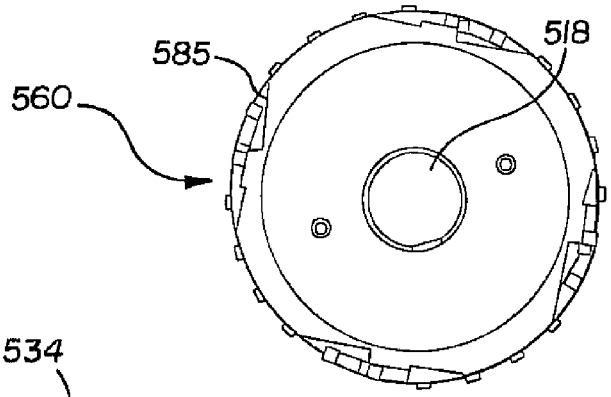
FIGS. 5(*a*)-(*e*) are (a) perspective, (b) side, (c) end, and (d) magnified perspective views of a rotary cutter according to the present invention depicting a replaceable blade.
Figure 5D:
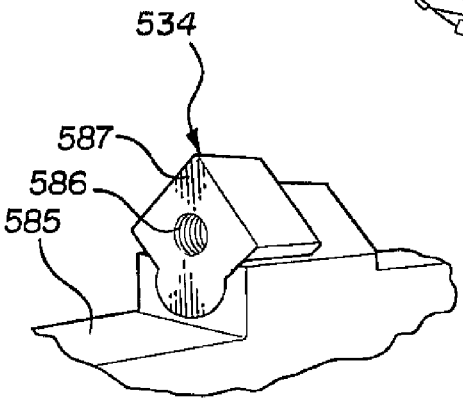
Figure 5E:
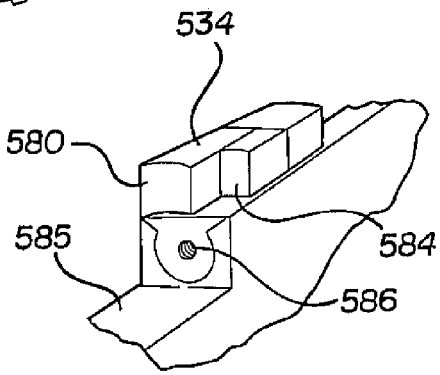
Figure 5A:
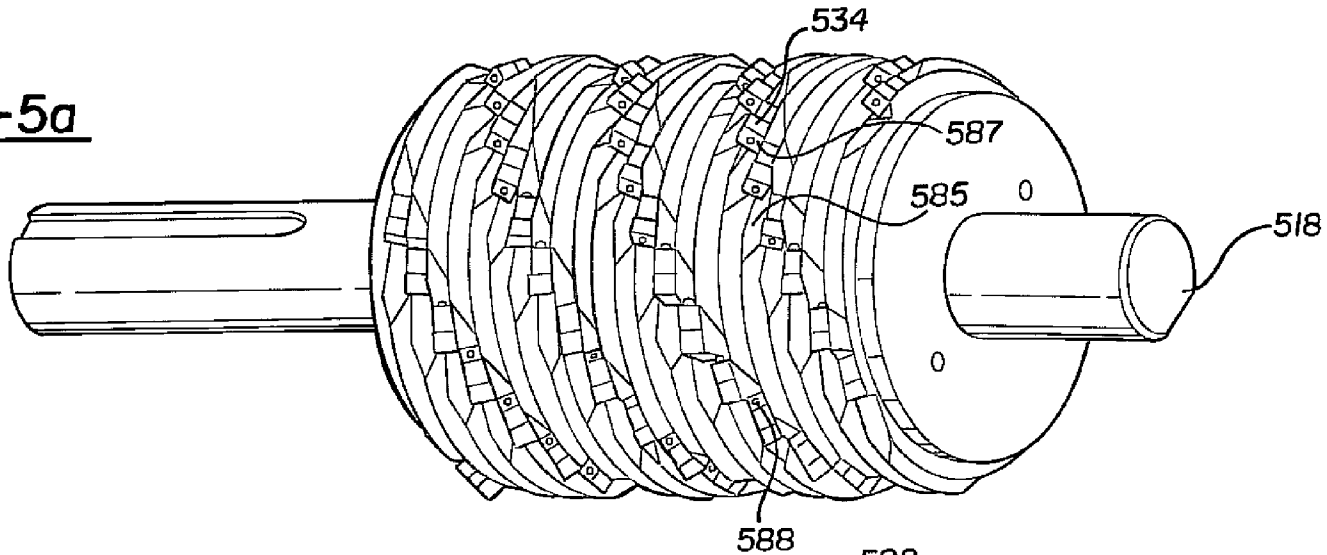
Figure 5B:
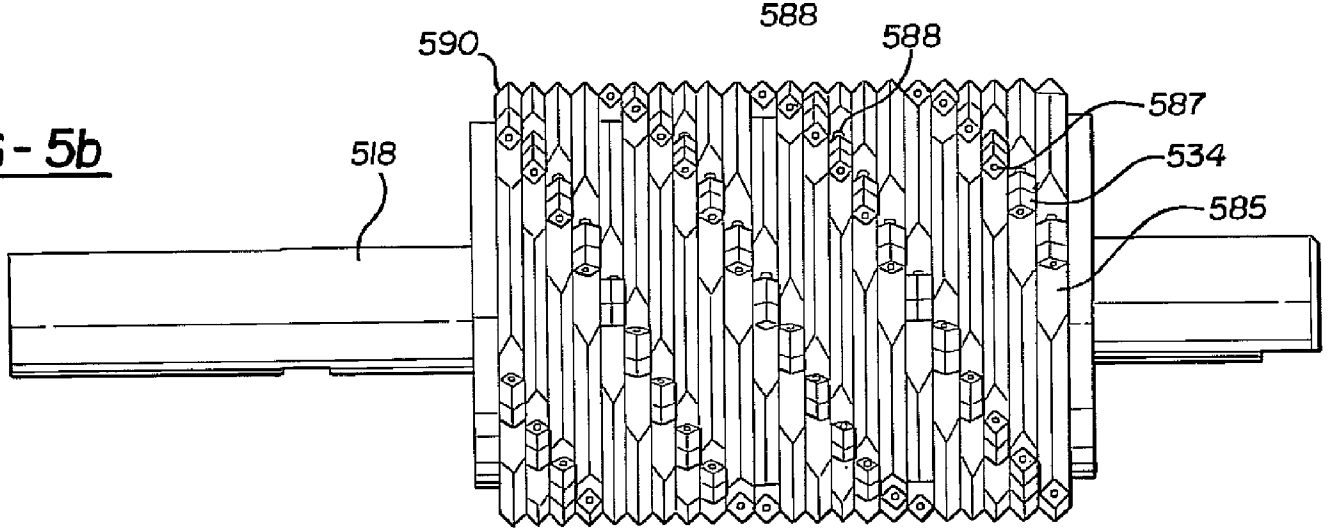

Another embodiment of a first cutting stage according to the present invention is depicted in FIG. 4. Five cutting segments 460 are staggered from one another to create a sequential cutting motion from distal to central portions of a cutting stage 414. Each cutting segment 460 has two cutting blades 434. A cutting blade 434 has a concave trailing edge 439. A rearward angled cutting edge 480 is characterized by having a leading tip 482 adapted to secure material as the remainder of the rearward angled cutting edge 480 and the trailing edge 439 drive the material towards a stationary cutter 432. The scissor-like cutting action of cutting blade 434 is particularly well suited for shearing of high strength-high flexural modulus materials illustratively including polycarbonates, LEXANs (Du Pont), liquid crystal polymers, polystyrene, polyacrylics, and thermoplastic elastomers. It is appreciated that any number of modifications to the tipped leading edge are readily made illustratively including multiple tips, serrations, and a tip extending the full length of the leading edge 480.

FIGS. 5(*a*)-(*d*) depict another embodiment of a cutting stage according to the present invention having a replaceable leading edge and particularly well suited for granulating bulk material such as toilet seats, door panels, bumpers and the like. According to this embodiment, a cutting segment 560 is mounted about a shaft 518. The cutting segment 560 has a notch 585. The base of the notch 585 terminates in a recess 586 adapted to receive a blade 534. Preferably, the blade 534 is secured in the recess 586 with a threaded fastener 588. Optionally, the threads within the blade 534 adapted to engage the threaded fastener 588 extend through the blade face 587. Preferably, the blade face 587 is concave in the direction of rotation. While an open aperture in the cutting blade face 587 will harmlessly collect material through use, it is appreciated that a cap (not shown) may be inserted into the blade face 587. Preferably, such a cap has a pointed tip extending from the blade face 587 to facilitate gripping of material. A stationary cutter (not shown) is designed to have an edge complementary to the side view edge 590. Preferably, the blades 534 are sequentially staggered on adjacent cutting segments 560 with an overlap such that a preceding blade holds material for a blade to cut, thereby lessening bumping. More preferably, each cutting segment 560 has a plurality of blades 534. FIG. 5(*e*) depicts an alternative embodiment of a bulk material cutter blade 534. A rectilinear cross sectional cutter blade 534'. The blade 534' is divided into a first cutting surface 580 and a set back second cutting surface 584. Preferably, the first and second cutting surfaces are concave in the direction of rotation. A stationary cutter (not shown) complementary to the cutter blade cross section is utilized to create a complete cutting stage according to the present invention. Other numbered elements of FIG. 5(*e*) correspond to the description thereof in conjunction with FIGS. 5(*a*)-(*d*). Optionally, deflector segments are interspersed among the cutting segments 560.

It is appreciated that a first stage cutter as depicted in FIGS. 1-5 is readily adapted to be used without a second stage, or screen for the granulation of thermoplastics, thermoplastic elastomers such as SANTOPRENE, and thermoresins.

Figure 6A:
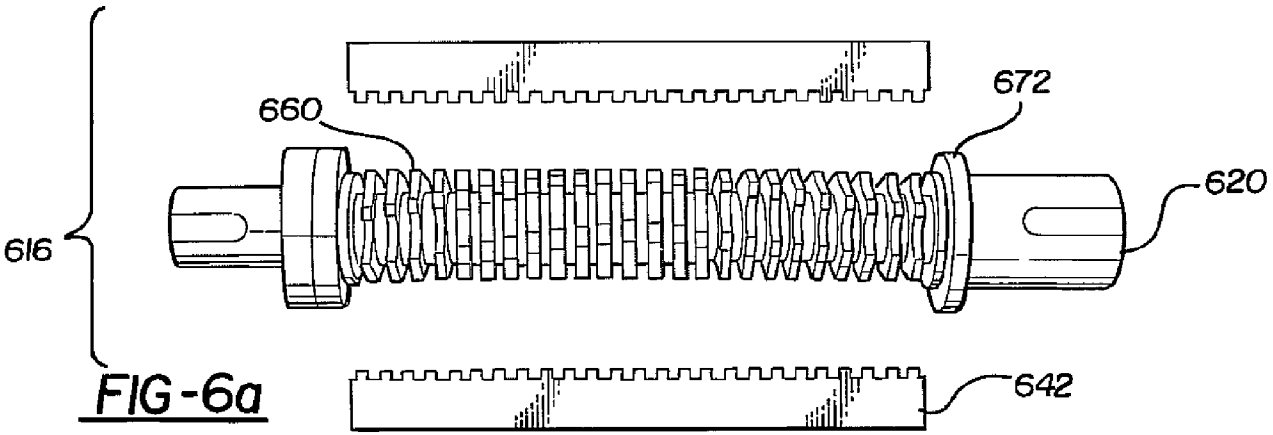
FIG. 6(*a*) is an exploded view of a second stage cutter assembly according to the present invention and 6(*b*) is a magnified side view of the second stage rotary cutter of 6(*a*).
Figure 6B:
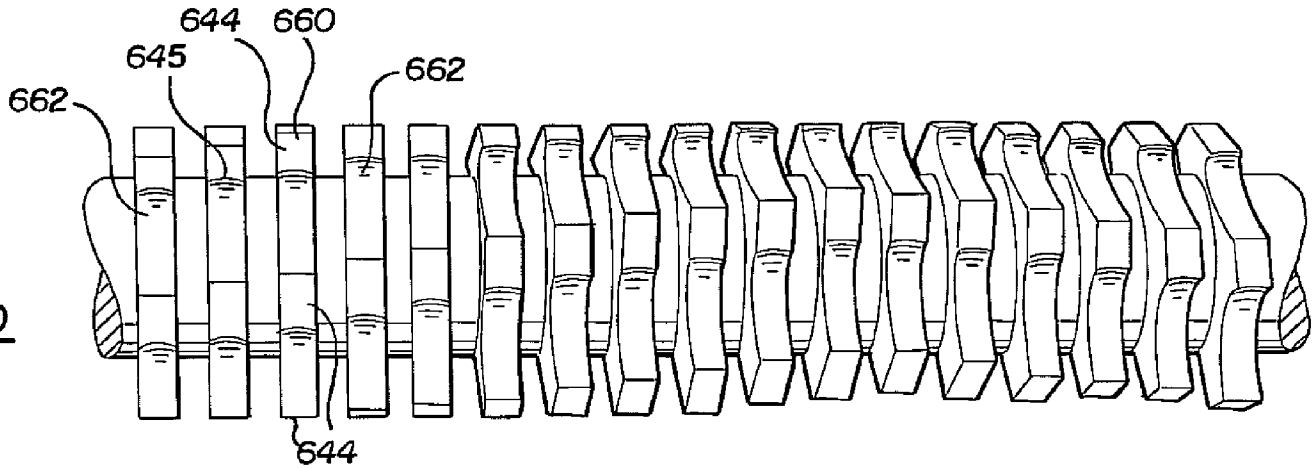

A second stage cutter 616 is depicted in FIGS. 6(*a*) and (*b*). A secondary cutting stage 616 includes a plurality of secondary cutter segments 660 and complementary stationary cutter 642. Each secondary cutter segment 660 has a plurality of blades 644 spread radially about the segment. A clearance exists between a stationary cutter 642 and a rotating blade 644. The clearance typically being from 1/1000 to ⅛ of an inch. Preferably, the cutting edge 645 of the blade 644 is concave. More preferably, the cutting edge 645 and the trailing edge 662 of blade 644 are concave.

Blades 644 of adjacent cutting segments 660 are preferably staggered radially from one another to lessen radial torque differences upon rotation of the second cutting stage 616. More preferably, blades 644 of adjacent cutting segments are staggered to produce a terminal to center sequential cutting sequence. As with reference to FIG. 3(*b*), a shaft 620 as shown in FIG. 6(*a*) includes a bearing race 672. Preferably, cutting segments and stationary cutters according to the present invention are constructed from a material having a Rockwell hardness of between 56 and 58. More preferably, cutting segments 660 and a stationary cutter 642 are constructed of D2 or CPM steel.

Various modifications of the present invention in addition to those shown and described herein will be apparent to those skilled in the art from the above description. Such modifications are also intended to follow from the scope of the appended claims.

All patents or other publications cited herein are incorporated by reference to the full extent as if each individual patent or other publication was individually incorporated by reference.

The invention claimed is:

1. A cutting stage comprising:

a rotatable shaft;

a cutter segment circumferentially engaging said shaft, said cutter segment having a blade extending away from said shaft;

a deflector segment adjacent to said cutter segment, said deflector segment having a cylindrical outer circumference with a notch covering only a portion of said deflector segment; and a stationary cutter having a cutting blade clearance and a deflector clearance.

2. The cutting stage of claim 1 wherein the cutting blade has a concave trailing edge.

3. The cutting stage of claim 1 wherein the cutting blade has a tipped cutting edge.

4. The cutting stage of claim 1 wherein the cutting blade comprises a plurality of cutting blades.

5. The cutting stage of claim 1 wherein the notch comprises a plurality of notches.

6. The cutting stage of claim 5 wherein said plurality of cutter segments sequentially engage material upon rotation about said shaft.

7. The cutting stage of claim 6 wherein the sequence by which said plurality of cutter segments engage material upon rotation about said shaft extends terminal to center of said shaft.

8. The cutting stage of claim 1 wherein said cutter segment comprises a plurality of cutter segments and said deflector segment comprises a plurality of deflector segments, said plurality of cutter segments being interspersed with said plurality of deflector segments.

9. The cutting stage of claim 8 wherein a cutter segment of said plurality of cutter segments has a number of blades greater than one and an adjacent deflector segment of said plurality of deflector segments has a number of notches equal to the number of adjacent cutter segment blades.

10. The cutting stage of claim 8 wherein a notch of the deflector segment leads a blade of the adjacent cutter segment by an angle of between 0.3 and 0.6 times the angle between blades of said cutter segment.

11. The cutting stage of claim 1 wherein said cutter segment is constructed of a material having a Rockwell hardness of between 56 and 58.

* * * * *